United States Patent [19]

Heiden

[11] Patent Number: 5,044,467

[45] Date of Patent: Sep. 3, 1991

[54] SCAFFOLD

[76] Inventor: Gary J. Heiden, Rte. 1, Box 324-B8, Meeker, Okla. 74855

[21] Appl. No.: 380,636

[22] Filed: Jul. 17, 1989

[51] Int. Cl.[5] ..... E04G 1/20

[52] U.S. Cl. ..... 182/130; 182/222; 248/231.6; 52/182

[58] Field of Search ..... 182/130, 1, 93, 90, 182/92, 222, 132; 52/187, 183; 248/231.6, 316.6

[56] References Cited

U.S. PATENT DOCUMENTS

| | | | |
|---|---|---|---|
| 502,367 | 8/1893 | Lake . | |
| 2,310,062 | 2/1943 | Broncato | 304/14 |
| 2,371,092 | 3/1945 | Williams | 228/2 |
| 3,092,382 | 6/1963 | Dunn | 182/115 X |
| 3,556,251 | 1/1971 | Whitehead | 182/93 |
| 3,731,761 | 5/1973 | Glenn | 182/1 |
| 3,750,845 | 8/1973 | Faulstick | 248/231.6 X |
| 4,023,859 | 5/1977 | Hagenson | 297/445 X |

FOREIGN PATENT DOCUMENTS

| | | | |
|---|---|---|---|
| 2651027 | 5/1978 | Fed. Rep. of Germany | 52/183 |
| 1468346 | 2/1967 | France | 52/183 |

*Primary Examiner*—Alvin C. Chin-Shue

*Attorney, Agent, or Firm*—Bill D. McCarthy; Glen M. Burdick

[57] ABSTRACT

A scaffold, having a main frame including four vertical posts arranged in a rectangular array and connected at the sides of the scaffold by two side trusses that support a scaffold main platform, is further provided with an auxiliary frame that supports a plurality of vertically spaced auxiliary platforms above the main platform and parallel thereto. The auxiliary frame is located at one end of the main frame and has two parallel side members, each side member having a first clamp member formed of angle stock at one end to receive a vertical post and a second clamp member formed of angle stock at the other end to receive a side truss. The vertical post is maintained with the first clamp member by a bent, partially threaded rod that is bolted to the perpendicular webs of the first clamp member and extends about the vertical post. The side truss is maintained within the second clamp member by a keeper plate bolted to the vertical web of the second clamp member and positioned to sandwich the side truss between such vertical web and the keeper plate. The side members are interconnected by at least one platform frame made of angle stock adapted to receive and stabilize the auxiliary platform.

4 Claims, 3 Drawing Sheets

SCAFFOLD

BACKGROUND OF THE INVENTION

1. Field of the Invention

The present invention relates generally to improvements in scaffolds, and more particularly, but not by way of limitation, to an auxiliary platform assembly attachable to a free standing scaffold of the type wherein a platform is supported by vertical posts arranged in a rectangular array.

2. Brief Description of the Prior Art

Free standing scaffolds are used in a wide variety of circumstances in which a tradesman must perform a task that requires his standing above floor level in a building. A painter in a room having a high ceiling will often erect a free standing scaffold so that he can reach the ceiling, as well as upper portions of the walls of the room. Similarly, an electrician will erect a scaffold in order to position himself appropriately with respect to lighting fixtures and wiring leading to such fixtures.

For convenience of use, scaffolds are conventionally constructed to enable a platform (upon which the tradesman stands while carrying out the task at hand) to be positioned at varying levels so that the tradesman can adjust his position in accordance with the requirements of the job. Thus, free standing scaffolds have, in the past, provided a convenient way of handling a variety of jobs in the building industry.

However, certain tasks impose requirements that cannot conveniently be met by prior art scaffolds. For example, in a room with a false ceiling, an electrician working on lighting fixtures will often find that a position of the scaffold platform that is convenient for mounting a lighting fixture to the false ceiling will be inconvenient for wiring the fixture and vice versa.

Moreover, prior art scaffolds make no provision for storage of tools, work materials and the like that are often needed to accomplish a task. A painter will often use one can of paint for the walls of a room, another for the ceiling and yet a third for trim between the wall and the ceiling. Further, he may use a brush to apply one color and one or more rollers and paint trays to apply the other colors. Unless he is prepared to dismount the scaffold each time he undertakes a new part of the job, he must clutter the scaffold with the materials and tools for all of these tasks with the danger that he may inadvertently kick, for example, a can of paint from the scaffold.

Additionally, prior art scaffolds make no provision for minor tasks that are most conveniently carried out on a workbench at a level with a persons waist. For example, a carpenter emplacing trim between a wall and ceiling of a room will often find it necessary to cut a piece of trim to a length that will fit a gap in trim already emplaced. However, the prior art scaffolds provide no convenient support for the trim while it is being cut.

Thus, while a free standing scaffold might provide the tradesman with a convenient way of positioning himself with respect to a task at hand, it will not, in many circumstances, enable him to conveniently carry out the task.

SUMMARY OF THE INVENTION

The present invention provides an auxiliary platform assembly for a scaffold that enables a tradesman to position himself at various heights in accordance with the task at hand without the need for adjusting the height of the scaffold, while at the same time providing shelving for storage of materials used on the job and a convenient work bench for carrying out a variety of tasks associated with the job. To this end, and in one aspect of the present invention, there is provided a scaffold comprised of a frame upon which a main platform can be mounted at a selected height and an auxiliary platform assembly which extends from one end of the frame selected distances toward the other end thereof to provide not only a plurality of storage shelves, usable as a workbench, but also supports upon which the tradesman may stand to gain additional height for portion of a task at hand.

In another aspect of the invention, the frame of the scaffold is comprised of a main frame which supports a main platform and the detachable auxiliary platform assembly which supports auxiliary platforms and is constructed to facilitate mounting of an auxiliary frame of the auxiliary platform assembly on the main frame of the scaffold.

In yet another aspect of the invention, the auxiliary frame comprises two parallel side members, each of the side members having a clamp at both ends thereof for attachment of the auxiliary frame to the vertical posts and horizontal side trusses of the main frame of the scaffold, and at least one support platform frame connected to the side members so as to extend therebetween, the support platform frame adapted to receive and support an auxiliary platform thereon above the main platform of the scaffold.

An object of the present invention is to provide a versatile scaffold which maximizes the convenience of the user in substantially any circumstances he might encounter without requiring the user to adjust the height of the scaffold.

Another object of the invention, while achieving the before stated object, is to provide an auxiliary platform attachable to a scaffold which enables the user to select one or a plurality of heights at which he might work in completing a task calling for the use of a scaffold.

Still a further object of the invention, while achieving the before stated objects, is to provide the user of a scaffold with safe storage of materials that might be used in the performance of a job from the scaffold.

Another object of the invention, while achieving each of the before stated objects, is to provide users of scaffolds with a workbench on the scaffold for facilitating tasks which might be entailed in the performance of a job.

Other objects, features and advantages of the present invention will become apparent from the following detailed description when read in conjunction with the drawings and appended claims.

Description of the Preferred Embodiment

Figure 1:
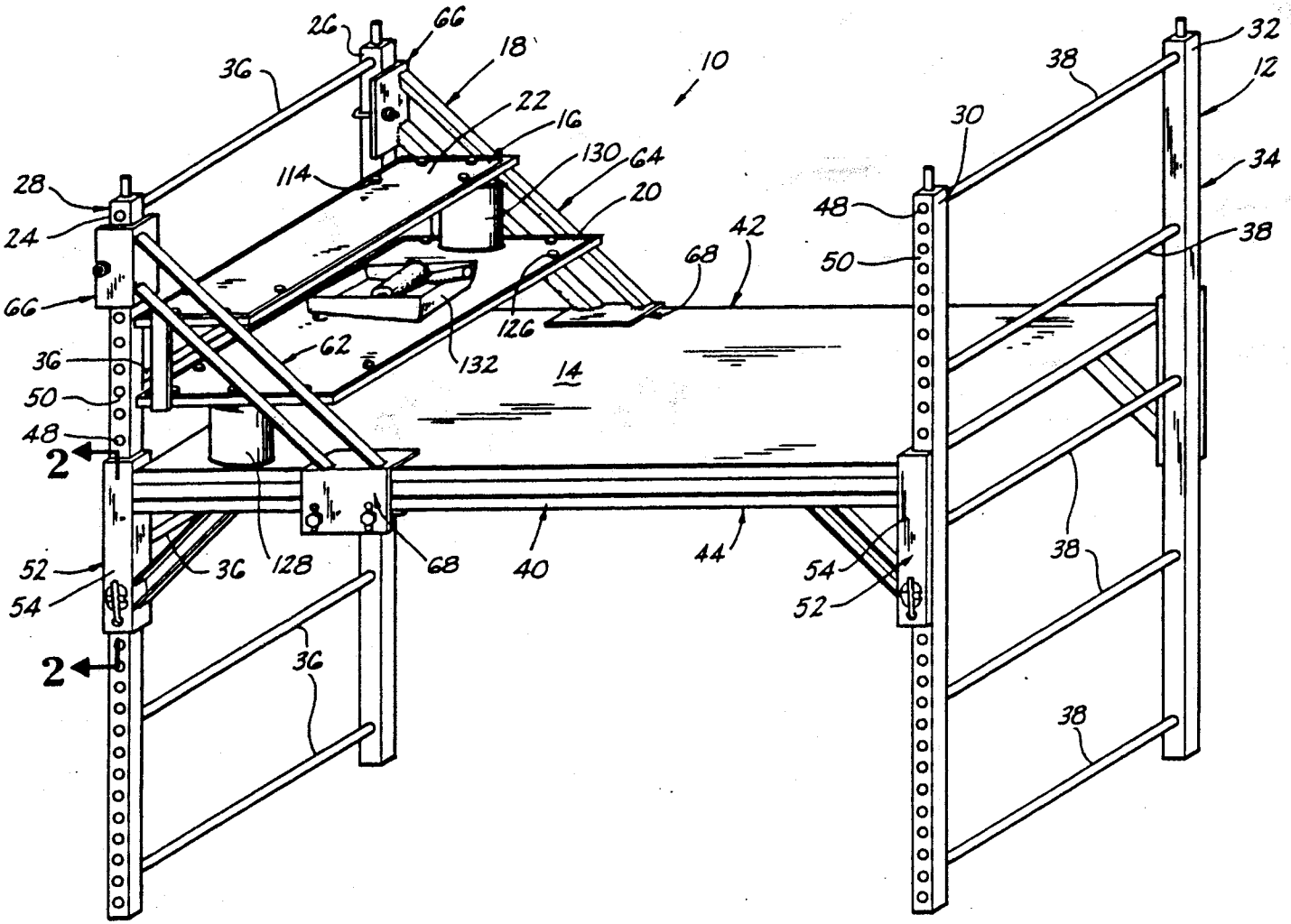
FIG. 1 is an isometric view of a scaffold constructed in accordance with the present invention.

Referring now to the drawings in general and to FIG. 1 in particular, shown therein and designated by the general reference numeral 10 is a scaffold. The scaffold 10, which is of conventional construction, comprises a main frame 12 that supports a main platform 14 at a selectable height with respect to the surroundings in which the scaffold 10 is used. An auxiliary platform assembly 16 is mounted on the main frame 12 of the scaffold 10.

The auxiliary platform assembly 16, which enables the workman to be positioned at varying levels, while at the same time providing a workbench on the scaffold 10, comprises an auxiliary frame 18 and auxiliary platforms 20 and 22. The main frame 12 of the scaffold 10, and the auxiliary frame 18 of the auxiliary platform assembly 16, thus provide a general frame (not numerically designated in the drawings) upon which the platforms 14, 20 and 22 are mounted in a vertically spaced, parallel arrangement.

The main frame 12 of the scaffold 10 comprises four vertical steel posts, posts 24 and 26 forming a first end 28 of the main frame 12; and posts 30 and 32 forming an opposite second end 34 of the main frame 12. The posts 24 and 26 are formed into a ladder structure by a plurality of bars 36 that are welded between the posts 24 and 26; and the posts 30 and 32 are similarly formed into a ladder structure by a plurality of bars 38. Along a first side 40 of the main frame 12, the posts 24 and 30 are connected by a first side truss 44; and, along a second side 42 of the main frame 12, the posts 26 and 32 are similarly connected by a second side truss 46 (see FIG. 3) which is constructed identically to the first side truss 44. For the latter connection, each of the posts 24, 26, 30 and 32 is constructed of square tubing having a series of vertically spaced slots 48 formed through the webs 50 thereof extending along the sides 40, 42 of the main frame 12; and each side truss 44, 46 is provided with a pair of connectors 52, constructed of angle stock, at each of its ends by means of which the side trusses 44, 46 are adjustably mounted on the posts 24, 26, 30 and 32 in a manner shown in FIG. 2.

Figure 2:
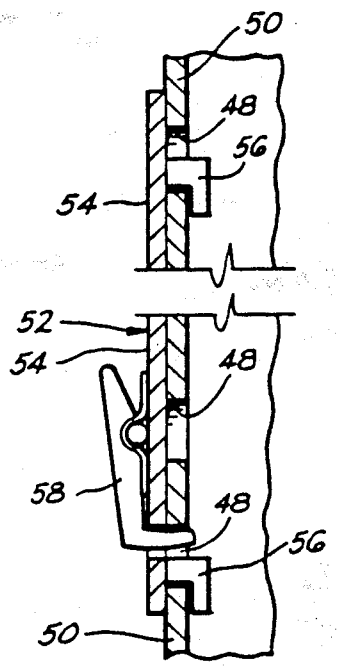
FIG. 2 is an enlarged cross sectional view taken along line 2—2 of FIG. 1.
Figure 3:
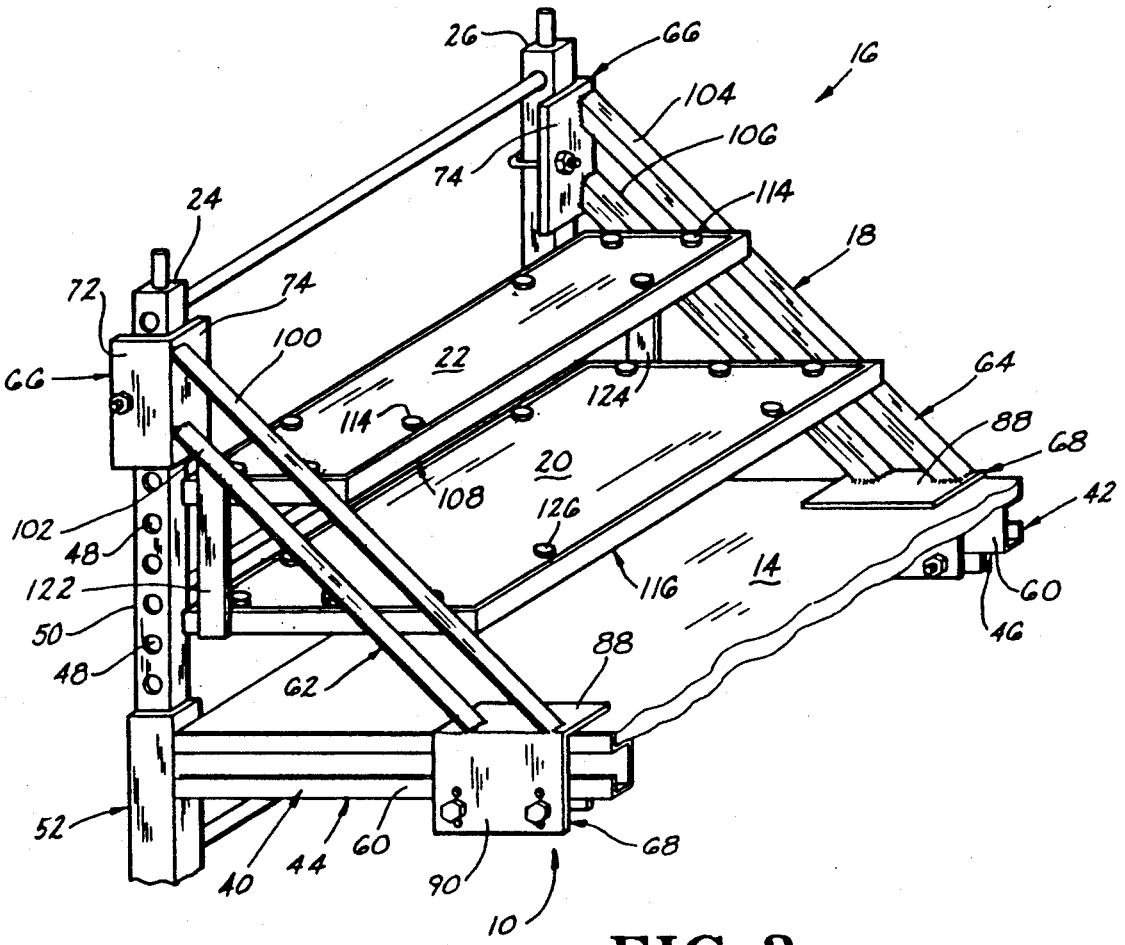
FIG. 3 is an isometric view of an auxiliary platform assembly of the scaffold of FIG. 1.

As shown in FIG. 1, the connectors 52 extend about two sides of each of the posts 24, 26, 30 and 32; and, as shown in FIG. 2, webs 54 of the connectors 52 (that engage the webs 50 of the posts) are provided with a pair of internal lugs 56 that are spaced to enter two of the slots 48. The lugs 56 have down-turned end portions to capture portions of the web 50; and each connector 52 is provided with a conventional pivoting latch 58 which prevents the lower of the lugs 56 from inadvertently being removed from the slot 48 in which such lug is disposed. As shown in FIG. 3, each of the side trusses 44, 46 comprises, in addition to the connectors 52, an elongated support 60 formed of folded sheet metal that provides shelves or support shoulders (not numerically designated in the drawings) on which the main platform 14 rests when the scaffold 10 is erected.

Figure 4:
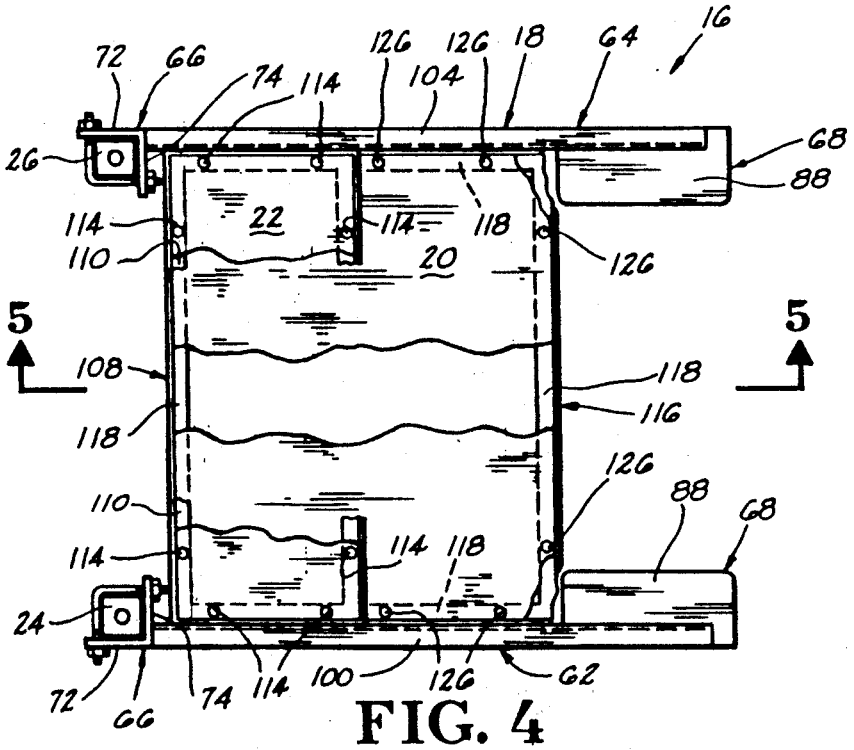
FIG. 4 is a top view, in partial cutaway, of the auxiliary platform assembly.
Figure 5:
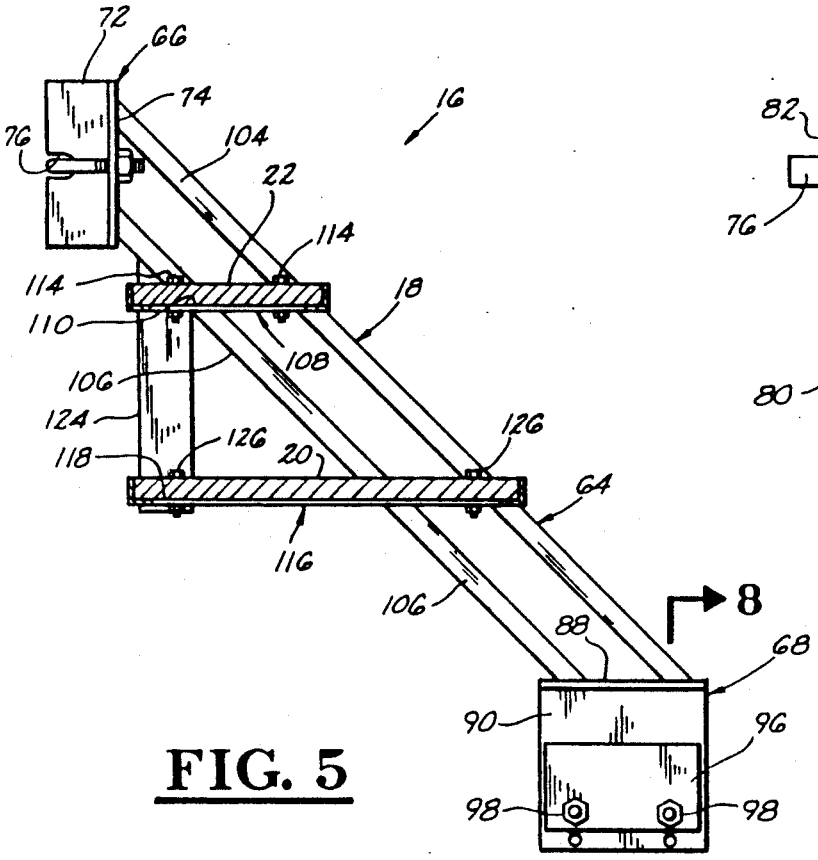
FIG. 5 is a cross-sectional view of the auxiliary platform assembly taken along line 5—5 of FIG. 4.
Figure 6:
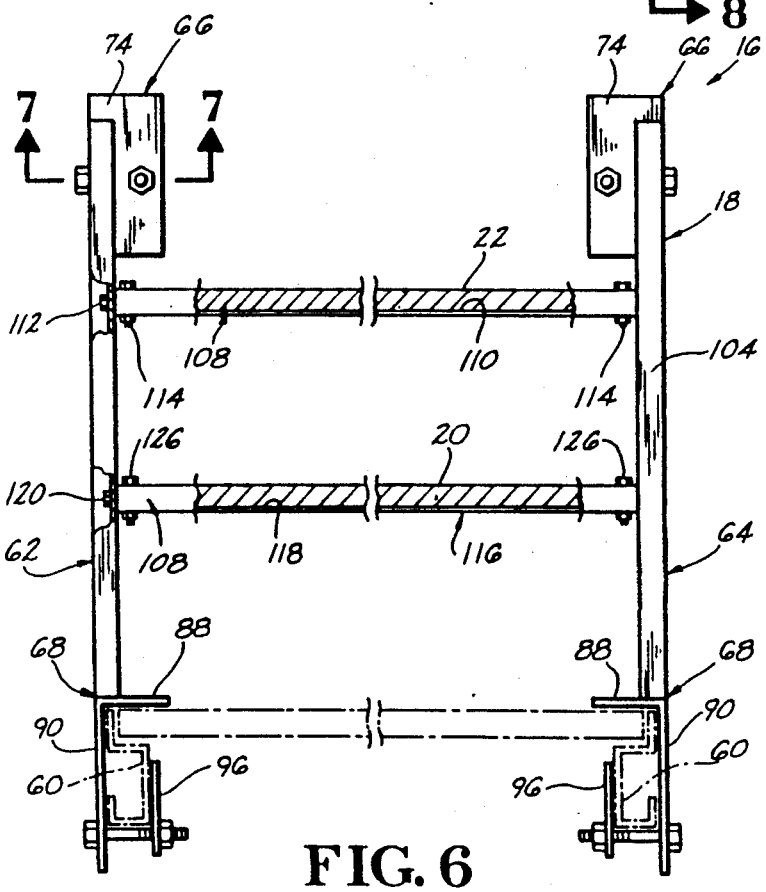
FIG. 6 is an end elevational view, in partial cutaway, or the auxiliary platform assembly.

With continuing reference to FIG. 3 and with additional reference to FIGS. 4 through 6, the auxiliary frame 18 of the auxiliary platform assembly 16, comprises two parallel side members, 62 and 64 which are spaced a distance apart substantially equal to the spacing of the vertical posts 24 and 26 of the main frame 12 for permitting the auxiliary frame 18 to be mounted on and secured to the main frame 12. For this purpose, each of the side members 62 and 64 is provided, at its upper end, with a first clamp 66 by means of which the side members 62 and 64 can be secured to the posts 24 and 26, respectively, of the main frame 12; and each of the side members 62 and 64 is provided at its lower end with a second clamp 68 by means of which the side members 62 and 64 can be secured to the side trusses 44 and 46, respectively, of the main frame 12.

Figure 7:
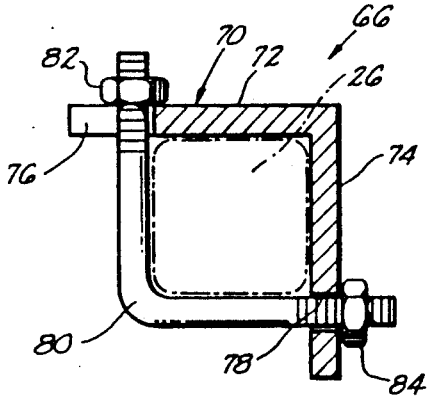
FIG. 7 is an enlarged cross-sectional view of a first clamp of the auxiliary platform assembly taken along line 7—7 of FIG. 6.
Figure 8:
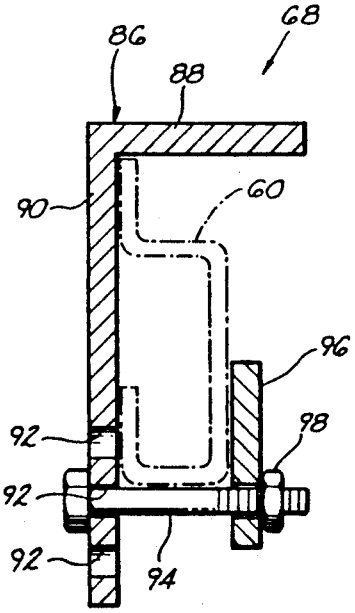
FIG. 8 is an enlarged cross-sectional view of a second clamp of the auxiliary platform assembly taken along line 8—8 of FIG. 5.

The construction of the first and second clamps 66 and 68 have been particularly illustrated in FIGS. 7 and 8 to which attention is now invited. As shown in FIG. 7, each first clamp 66 comprises a post engagement member 70 constructed of angle stock having perpendicular webs 72 and 74. The webs 72 and 74 are positioned vertically (see FIG. 3) and extend along two sides of a vertical post, such as vertical post 26, so that the post is positioned within the angle formed between the web 72 and 74 of the post engagement member 70.

A slot 76 is formed in the web 72 which intersects the edge of the web 72 and extends a distance toward the web 74. A hole 78 is formed through the web 74 so that the post, such as the post 26, can be secured within the angle of the post engagement member 70 by a bent rod 80. That is, the bent rod 80 is provided with threaded end portions that pass through the slot 76 and the hole 78 for bolting to the webs 72 and 74 via nuts 82 and 84 so that a central portion of the bent rod 80 extends about remaining portions of the post.

As shown in FIG. 8, each second clamp 68 comprises a truss engagement member 86 constructed of angle stock having webs 88 and 90 that are positioned horizontally and vertically, respectively, to extend along the tops and sides of the elongated supports 60 of the truss members 44 and 46 so that a portion of each of the elongated supports 60 is positioned within the angle formed between the webs 88 and 90 of the truss engagement member 86. A series of vertically aligned holes 92 is formed through the vertical web 90, adjacent each end thereof. The vertically aligned holes 92 are adapted to receive bolts 94 so that an apertured keeper plate 96 can be attached to the truss engagement member 86 via the bolts 94 and nuts 98 and thereby secure the side trusses 44 and 46 within the angles of the truss engagement members. It will be noted that providing the webs 90 with a series of vertically aligned holes 92 the keeper plates 96 of the second clamps 68 can be positioned to mate with side trusses having elongated supports 60 of substantially any width.

Referring again to FIGS. 3-6, the side member 62 of the auxiliary frame 18 further comprises a pair of parallel, spatially disposed stringers 100, 102 which extend between and are welded to the clamps 66 and 68. Similarly, side member 64 of the auxiliary frame 18 comprises a pair of parallel, spatially disposed stringers 104, 106 which extend between and are welded to the clamps 66 and 68. As particularly shown for the stringers 104 and 106 in FIG. 5, each of the stringers of the side members 62 and 64 is constructed of angle stock to facilitate mounting of the auxiliary platforms 20 and 22.

To this end, and for mounting the auxiliary platform 22 to the auxiliary frame 18, the auxiliary frame 18 further comprises a first platform frame 108 adapted to receive and support the auxiliary platform 22. The first platform frame 108, which is constructed of a plurality of interconnected segments of angle stock, defines a platform support shoulder or shelf 110 about the interior portion of the first platform frame 108. That is, four segments of angle stock are connected at their adjacent ends to define a substantially rectangular configuration wherein a lower web of each of the segments extends inwardly to define the platform support shoulder 110. Thus, the first platform frame 108, which is dimensioned to extend between the side members 62, 64 can be connected to the stringers 100, 102 of the side member 62 and the stringers 104, 106 of the side member 64 by any suitable means.

For example, if one desires that the auxiliary platform assembly 16 be collapsible to facilitate storage, the first platform frame 108 can be secured to the stringers 100–106 via a plurality of bolts, such as bolts 112 (see FIG. 6), in a customary manner. On the other hand, if one does not desire or require that the auxiliary platform assembly 16 be collapsible, the first platform frame 108 can be welded to the stringers 100–106. In either instance, the connection of the first platform frame 18 to the stringers 100–106 is enhanced because of the large area provided between the first platform frame 18 and the adjacently disposed portion of the stringers 100–106.

As previously stated, the first platform frame 108 is provided with platform support shoulders 110 adapted to receive and support the auxiliary platform 22. If desired, the auxiliary platform 22 can be secured to the platform support shoulder 110 by any suitable means, such as by a plurality of bolts positioned through holes formed in the platform support shoulder 110 which are aligned with holes formed in the peripheral portion of the auxiliary platform 22, such as bolts 114 (see FIG. 3–6), in a conventional manner.

To mount the auxiliary platform 20 to the auxiliary frame 18, the auxiliary frame 18 further comprises a second platform frame 116 adapted to receive and support the auxiliary platform 20. The second platform frame 116 is similar in construction to the first platform 108; and thus the second platform frame 116 is also constructed of a plurality of interconnected segments of angle stock which define a platform support shoulder or shelf 118 about the interior portion of the second platform frame 116. That is, four segments of angle stock are connected at their adjacent ends to define a substantially rectangular or square shaped configuration, as the case may be, wherein a lower web of each of the segments extends inwardly to define the platform support shoulder 118.

The second platform frame 116 is dimensioned to extend between the side members 62, 64 and to have a depth or width greater than the first platform frame 108. That is, the second platform frame 116 extends a greater distance from the first end 28 of the main frame 12 than the first platform frame 108. Thus, the second platform frame 116 can be connected to the stringers 100, 102 of the side member 16 and the stringers 104, 106 of the side member 64 by any suitable means, depending upon whether the auxiliary platform assembly 16 is to be collapsible to facilitate storage or whether same is constructed as a unitary component.

That is, if the auxiliary platform assembly 16 is to be collapsible the second platform frame 116 is connected to the stringers 100–106 via a plurality of bolts, such as bolts 120, in a customary manner. On the other hand, if one does not desire or require that the auxiliary platform assembly 16 be collapsible, the second platform frame 116 can be welded to the stringers 100–106.

To further stabilize the second platform frame 116 the auxiliary frame 18 further comprises depending brackets 122 and 124 that are welded to stringers 102 and 106, respectively. The second platform frame 116 can then be connected to the depending brackets 122 and 124 by any suitable means depending on whether the auxiliary platform assembly 16 is to be constructed so as to be collapsible to facilitate storage, or whether same is to be constructed as a unitary component. Thus, when fabricating the auxiliary platform assembly 16 as a collapsible unit, the second platform frame 116 can be bolted to the brackets 122 and 124; whereas when constructed as a unitary component the second platform frame 116 can be welded to the depending brackets 122 and 124.

The second platform frame 116 is, as previously stated, provided with a platform support shoulder, 118 adapted to receive and support the auxiliary platform 20. If one desires, the auxiliary platform 20 can be secured to the platform support shoulder 118 by any suitable means, such as by a plurality of bolts 126 disposed through holes formed in the platform support shoulder 118 which are aligned with holes formed in the peripheral portion of the auxiliary platform 20.

From the above, it becomes apparent that the auxiliary platforms 20 and 22 are connected to the auxiliary frame 18 of the auxiliary platform 16 such that the auxiliary platforms 20 and 22 extend from the first end 28 of the main frame 12 when the auxiliary platform assembly 16 is mounted thereon. Thus, the auxiliary platforms 20 and 22 of the auxiliary platform assembly 16 provide shelving that can be used to store a variety of articles for subsequent use by a tradesman on the scaffold 10 or to enable the tradesman to elevate himself using the scaffold to accomplish tasks which would not be reachable from the main platform 14 of the scaffold 10.

Operation

The scaffold 10 can be prepared for use by assembly at a work site, such assembly commencing with the assembly of the main frame 12 by mounting the side trusses on the vertical posts as discussed above and placing the main platform on the side trusses as has been illustrated in the drawings.

For the mounting of the auxiliary platform assembly 16 on the main frame 12, the keeper plates 96 and bolts 94 of the second clamps 68 of the side members 62 and 64 are removed. The nuts 82 and 84 on the bent rods 80 of the first clamp members 66 are then loosened sufficiently to permit the post engagement members 70 to be moved onto the vertical posts 24 and 26 from above and the auxiliary frame assembly 18 is lowered until the webs 88 of the truss engagement members 86 rest on the elongated supports 60 of the side trusses 44 and 46 and the main platform 14 as shown in FIG. 3. The nuts 82 and 84 are then tightened to secure the first clamps 66 to the posts 24 and 26.

The bolts 94 are then inserted through selected holes in the webs 90 of the second clamps 68, so as to secure the keeper plates 96 to the bolts 94 via the nuts 98. If the auxiliary platform assembly 16 is constructed to be collapsible to facilitate storage, the first and second platform frames 108 and 116 must be connected to the stringers 100–106 and the depending brackets 122 and 124. However, it should be understood that the connection of the first and second platform frames 108 and 116 to the stringers 100–106, the connection of the second platform frame 116 to the depending brackets 122 and 124, as well as the connection of the auxiliary platforms 20 and 22 to the first and second platform frames 108 and 116 can be accomplished either before or after connection of the auxiliary frame 18 to the main frame 12 of the scaffold 10.

Once the assembly of the scaffold 10 and the auxiliary platform assembly 16 has been completed, and prior to the tradesman beginning the task, the tradesman of the scaffold 10 will select tools, materials and the like that he will use in carrying out the task and these will be placed on or under the shelves provided by the above described construction of the auxiliary platforms assembly 16 as has been illustrated for cans 128 and 130 and a paint tray 132 in FIG. 1. Thereafter, the tradesman mounts the scaffold via the bars 38 at the second end 34 of the scaffold 10 and commences work using whatever tools and materials are appropriate for the initial stages of the task. Should the tradesman need to use a different tool or different materials as the work progresses, he need only move to the auxiliary platforms 20, 22 and exchange the tool or materials he has been using for those pre-emplaced on the platforms 20, 22.

Similarly, should the tradesman need additional height to accomplish some portion of the task, he can stand on one or both of the auxiliary platforms 20, 22 to achieve such height. Moreover, because of the construction of the auxiliary platforms 20, 22 so as to extend a selected distance from the first end of the main frame 12, the tradesman can achieve the additional height without incurring the possibility of accidentally dislodging articles from the auxiliary platforms 20, 22. That is, storage of articles can be confined to portions of the auxiliary platforms 20, 22 which are inaccessible to the tradesman's feet. Finally, should the tradesman need to prepare materials for use in the task at hand, he need merely pick up an appropriate tool from the auxiliary platforms 20, 22, place the materials on the auxiliary platform 22, which can function as a convenient workbench, and carry out the needed operation on the materials.

From the foregoing description, it will be clear that the present invention is well adapted to carry out the objects and attain the ends and advantages mentioned as well as those inherent therein. While a presently preferred embodiment has been described for purposes of this disclosure, numerous changes may be made which will readily suggest themselves to those skilled in the art and which are encompassed in the spirit of the invention disclosed and as defined in the appended claims.

What is claimed is:

1. An auxiliary frame for mounting a plurality of auxiliary platforms above a main platform of a scaffold of the type wherein the main platform is supported by two parallel side trusses connected perpendicularly to a plurality of vertical end posts arranged in a substantially rectangular array, each of the vertical end posts extending upwardly from the side trusses and the main platform, the auxiliary frame comprising:

two substantially parallel side members spaced a distance apart substantially equal to the spacing between two of the vertical end posts, each of the side members characterized as having an upper end and a lower end;

first connecting means for connecting the upper end of each of the side members to one of the vertical end posts, the first connecting means comprising:

a post engagement member constructed of angle stock having perpendicular webs engaging two sides of the vertical post; and a bent rod having threaded end portions bolted to the webs of the post engagement member and a central portion extending about remaining sides of the vertical post;

second connecting means for connecting the lower end of each of the side members to one of the side trusses; and means connected to the side members and extending therebetween for supporting the auxiliary platforms on the auxiliary frame.

2. The auxiliary frame of claim 1 wherein the second connecting means comprises:

a truss engagement member constructed of angle stock and having a horizontal web overlaying the side truss and a vertical web extending along one side of the side truss; and a keeper plate bolted in a parallel relation to the vertical web of the truss engagement member on the opposite side of the side truss.

3. The auxiliary frame of claim 2 wherein the vertical web of the truss engagement member is characterized as having formed therethrough at least one series of vertically aligned bolt holes whereby the keeper plate can be bolted at selected levels on the truss engagement member.

4. An auxiliary frame for mounting a plurality of auxiliary platforms above a main platform of a scaffold of the type wherein the main platform is supported by two parallel side trusses connected perpendicularly to a plurality of vertical end posts arranged in a substantially rectangular array, each of the vertical end posts extending upwardly from the side trusses and the main platform, the auxiliary frame comprising:

two substantially parallel side members spaced a distance apart substantially equal to the spacing between two of the vertical end posts, each of the side members characterized as having an upper end and a lower end;

first connecting means for connecting the upper end of each of the side members to one of the vertical end posts;

second connecting means for connecting the lower end of each of the side members to one of the side trusses, the second connecting means comprising:

a truss engagement member constructed of angle stock and having a horizontal web overlaying the side truss and a vertical web extending along one side of the side truss; and a keeper plate bolted in a parallel relation to the vertical web of the truss engagement member on the opposite side of the side truss; and means connected to the side members and extending therebetween for supporting the auxiliary platforms on the auxiliary frame.

* * * * *

UNITED STATES PATENT AND TRADEMARK OFFICE

CERTIFICATE OF CORRECTION

PATENT NO. : 5,044,467

DATED : September 3, 1991

INVENTOR(S) : Gary J. Heiden

It is certified that error appears in the above-identified patent and that said Letters Patent is hereby corrected as shown below:

On the title page:

[56] References Cited, delete "3,092,382" and substitute therefor --3,092,383--; and

[56] References Cited, delete "Faulstick" and substitute therefor --Faulstich--.

Signed and Sealed this

Ninth Day of March, 1993

*Attest:*

STEPHEN G. KUNIN

*Attesting Officer*

*Acting Commissioner of Patents and Trademarks*